US010731323B2

(12) United States Patent
Fukuda et al.

(10) Patent No.: US 10,731,323 B2
(45) Date of Patent: Aug. 4, 2020

(54) HYDRAULIC SYSTEM FOR WORKING MACHINE

(71) Applicant: KUBOTA CORPORATION, Osaka (JP)

(72) Inventors: Yuji Fukuda, Osaka (JP); Keigo Honda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/432,070

(22) Filed: Jun. 5, 2019

(65) Prior Publication Data

US 2020/0056352 A1 Feb. 20, 2020

(30) Foreign Application Priority Data

Aug. 17, 2018 (JP) ..... 2018-153593

(51) Int. Cl.
*E02F 9/22* (2006.01)

(52) U.S. Cl.
CPC ..... *E02F 9/2296* (2013.01); *E02F 9/226* (2013.01); *E02F 9/2267* (2013.01); *F15B 2211/20546* (2013.01); *F15B 2211/275* (2013.01)

(58) Field of Classification Search
CPC .... F15B 2211/30525; F15B 2211/3105; F15B 2211/3122; F15B 2211/3133; F15B 2211/31511; E02F 9/2285; E02F 9/2296; E02F 9/2267; E02F 9/226
See application file for complete search history.

(56) References Cited

U.S. PATENT DOCUMENTS

2017/0175779 A1* 6/2017 Fukuda ..... F15B 11/16

FOREIGN PATENT DOCUMENTS

JP 2010-270527 12/2010

* cited by examiner

*Primary Examiner* — Abiy Teka
(74) *Attorney, Agent, or Firm* — Greenblum & Bernstein, P.L.C

(57) ABSTRACT

A hydraulic system includes a hydraulic pump to be driven by a prime mover, a first hydraulic actuator, a second hydraulic actuator, a first connecting fluid tube connected to the first hydraulic actuator, a second coupling hydraulic tube connected to the first hydraulic actuator, and a first control valve having a first position and a second position. The hydraulic system includes a second control valve configured to control the second hydraulic actuator, a first fluid tube configured to supply a return fluid to the second control valve, a second fluid tube connected to the first fluid tube, a first communicating-connection tube to be connected to the second fluid tube when the first control valve is in the first position, and a second communicating-connection tube to be connected to the second fluid tube when the first control valve is in the second position.

15 Claims, 2 Drawing Sheets

16
18
83a
83b
20c1
20c3
20(20C)
20c2
39
44a
44b
44c
29b
93
94
17
17
17c
17d
17a
17b
17e
22b
22a
22
20b1
43c
72
20(20B)
81
73c
36
20b2
35
20b3
38
110
111
81c
120
121
38
34a
34b
81a
81b
43a
43b
42a
42b
42c
24b4
14
14b
14a
14e
14
29a
24b3
14c
14d
63
64
21b
21a
21
51
41c
61
20a1
20a3
31
61a
20a2
24b1
20(20A)
53c
32
37
33a
33b
41b
41a
46b
46a
46c
61b
47a
25
24a
24b3
24b2
24b
P1
27
E
P2
7
15

HYDRAULIC SYSTEM FOR WORKING MACHINE

CROSS-REFERENCE TO RELATED APPLICATIONS

The present application claims priority under 35 U.S.C. § 119 to Japanese Patent Application No. 2018-153593, filed Aug. 17, 2018. The content of this application is incorporated herein by reference in their entirety.

BACKGROUND OF THE INVENTION

Field of the Invention

The present invention relates to a hydraulic system for a working machine such as a skid steer loader and a compact truck loader.

Description of Related Art

A hydraulic system for a working machine disclosed in Japanese Patent Application publication No. 2010-270527 is previously known. The hydraulic system for the working machine disclosed in Japanese Patent Application publication No. 2010-270527 includes a bucket control valve, a main pump, and a bucket cylinder. The bucket control valve includes two pump ports to which pressured fluid from the main pump is inputted, two cylinder ports for supplying and discharging the pressures fluid to the rod side fluid chamber and the bottom side fluid chamber of the bucket cylinder, and a tank port communicated with a tank. In the bucket control valve, one pump port is communicated with the tank port through a bucket bleed circuit at a shoveling position of the bucket control valve. In addition, the bucket control valve is communicated with a cylinder port whose other pump port is connected to a fluid chamber provided for the shoveling operation of the bucket of the bucket cylinder.

SUMMARY OF THE INVENTION

A hydraulic system for a working machine according to one aspect of the present invention, includes a prime mover, a hydraulic pump to be driven by the prime mover and to output an operation fluid, a first hydraulic actuator, a second hydraulic actuator, a first connecting fluid tube connected to the first hydraulic actuator, a second coupling hydraulic tube connected to the first hydraulic actuator, and a first control valve. The first control valve has a first position allowing the operation fluid to be supplied to the first connecting fluid tube, and a second position allowing the operation fluid to be supplied to the second connecting fluid tube. The hydraulic system includes a second control valve arranged on a downstream side of the first control valve and configured to control the second hydraulic actuator, a first fluid tube coupling the first control valve to the second control valve and being configured to supply a return fluid to the second control valve, the return fluid being the operation fluid returning from any one of the first connecting fluid tube and the second connecting fluid tube to the first control valve, a second fluid tube coupling the first control valve to the second control valve and being connected to the first fluid tube, a first communicating-connection tube to be connected to the second fluid tube when the first control valve is in the first position, and a second communicating-connection tube to be connected to the second fluid tube when the first control valve is in the second position.

The hydraulic system includes a bucket and an auxiliary attachment arranged on the boom. The first hydraulic actuator is a bucket cylinder to operate the bucket. The second hydraulic actuator is an auxiliary actuator to operate the auxiliary attachment. The first control valve is a bucket control valve to control the bucket cylinder. The second control valve is an auxiliary control valve to control auxiliary hydraulic devices including the auxiliary attachment and the auxiliary actuator.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
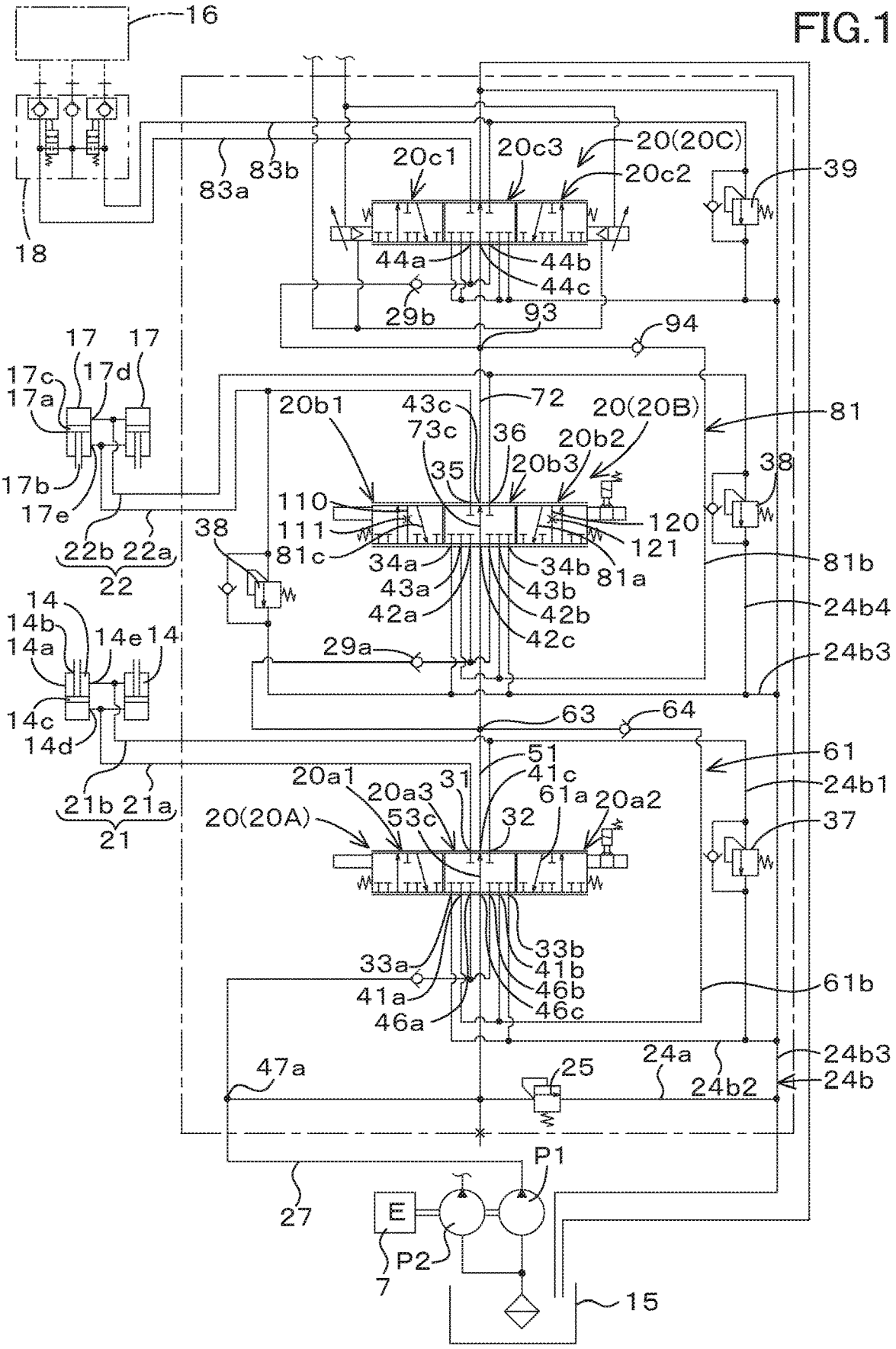
FIG. 1 is a view illustrating a hydraulic system (a hydraulic circuit) for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Hereinafter, an embodiment of a hydraulic system for a working machine and the working machine having the hydraulic system of the present invention will be described with reference to the drawings.

First, the working machine will be described.

Figure 2:
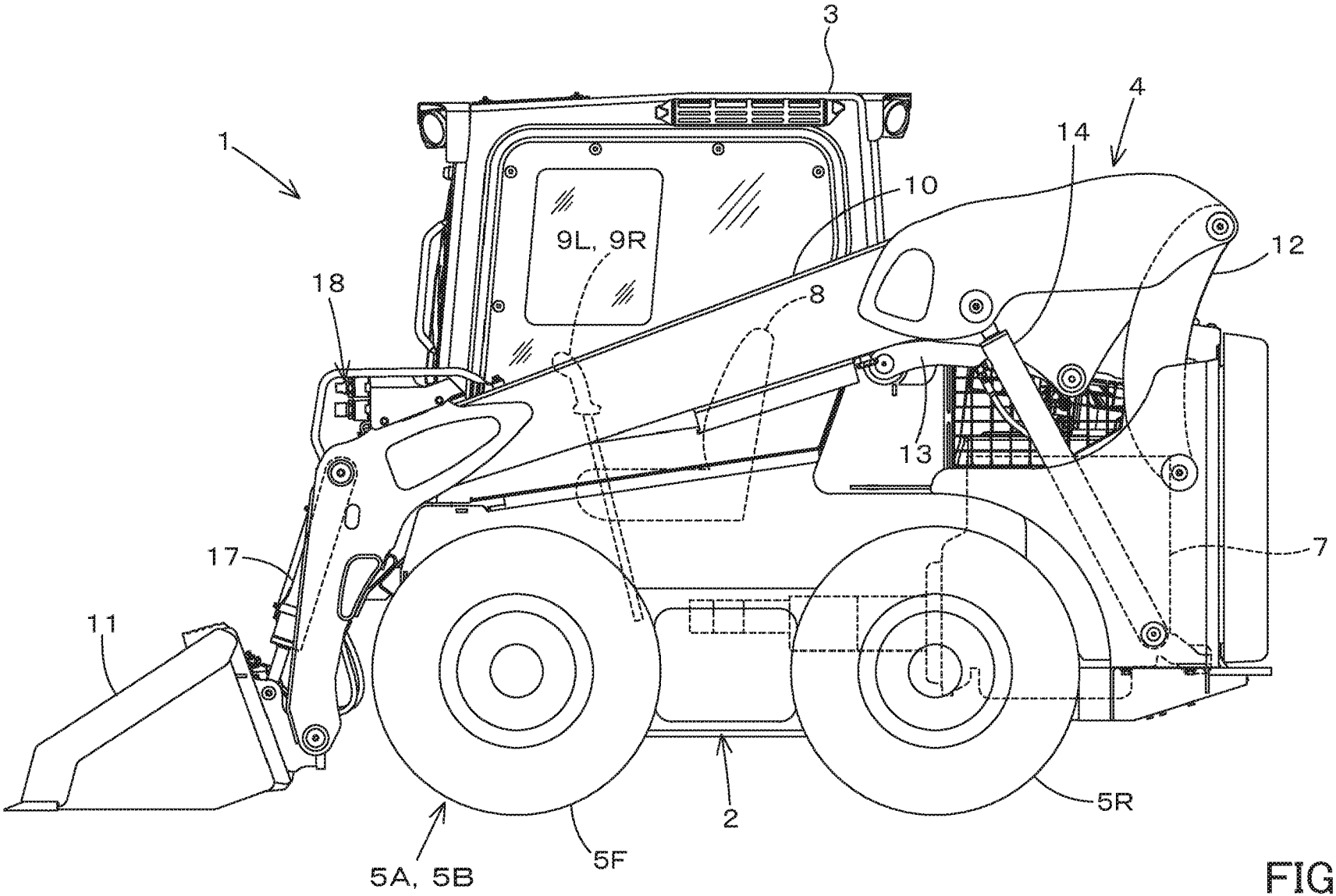
FIG. 2 is a whole view of a skid steer loader exemplified as the working machine according to the embodiment.

FIG. 2 shows a side view of a working machine according to the embodiment of the present invention. In FIG. 2, a skid steer loader is shown as an example of the working machine. However, the working machine according to the present invention is not limited to the skid steer loader, and may be, for example, another type of loader working machine such as a compact track loader. In addition, a working machine other than the loader working machine may be employed.

The working machine 1 includes an machine body (a vehicle body) 2, a cabin 3, a working device 4, a traveling device 5A, and a traveling device 5B.

A cabin 3 is mounted on the machine body 2. An operator seat 8 is provided at a rear portion of the cabin 3. In the embodiment of the present invention, the front side (the left side in FIG. 2) of the operator seated on the operator seat 8 of the working machine 1 is referred to as the front, the rear side (the right side in FIG. 2) of the operator is referred to as the rear, the left side of the operator is referred to as the left, and the right side is referred to as the right side.

Moreover in the explanation of the embodiment, the horizontal direction which is a direction orthogonal to the front-rear direction is referred to as a machine width direction. The direction extending from the central portion of the machine body 2 to the right portion or the left portion will be described as a machine outward direction.

In other words, the machine outward direction corresponds to the machine width direction and is the direction separating away from the machine body 2. A direction opposite to the machine outward direction will be described as a machine inward direction. In other words, the machine inward direction corresponds to the machine width direction and is the direction approaching the machine body 2.

The cabin 3 is mounted on the machine body 2. The working device 4 is a device that performs the working, and is provided on the machine body 2.

The traveling device 5A is a device for causing the machine body 2 to travel, and is provided on the left side of the machine body 2. The traveling device 5B is a device for causing the machine body 2 to travel, and is provided on the right side of the machine body 2. A prime mover 7 is provided at the rear portion of the machine body 2.

The prime mover 7 is constituted of a diesel engine (an engine). The prime mover 7 is not limited to the engine, and may be an electric motor or the like.

A traveling lever 9L is provided on the left side of the operator seat 8. A traveling lever 9R is provided on the right side of the operator seat 8. The traveling lever 9L arranged on the left is configured to operate the traveling device 5A arranged on the left, and the traveling lever 9R arranged on the right is configured to operate the traveling device 5B arranged on the right.

The working device 4 has a boom 10, a bucket 11, a lift link 12, a control link 13, a boom cylinder body 14 and a bucket cylinder 17. The boom 10 is provided on the side of the machine body 2.

The bucket 11 is provided at the tip end (a front end) of the boom 10. The lift link 12 and the control link 13 support the base portion (the rear portion) of the boom 10. The boom cylinder body 14 moves the boom 10 upward and downward.

In particular, the lift link 12, the control link 13 and the boom cylinder body 14 are arranged on the side of the machine body 2. The upper portion of the lift link 12 is pivotally supported by the upper portion of the base portion of the boom 10. The lower portion of the lift link 12 is pivotally supported by the rear portion of the machine body 2.

The control link 13 is arranged in front of the lift link 12. One end of the control link 13 is pivotally supported by the lower portion of the base portion of the boom 10, and the other end is pivotally supported by the machine body 2.

The boom cylinder body 14 is a hydraulic cylinder configured to move the boom 10 upward and downward. The upper portion of the boom cylinder body 14 is pivotally supported by the front portion of the base portion of the boom 10. The lower portion of the boom cylinder body 14 is pivotally supported by the side portion of the rear portion of the machine body 2.

When the boom cylinder body 14 is stretched and shortened, the boom 10 is swung upward and downward by the lift link 12 and the control link 13.

The bucket cylinder 17 is a hydraulic cylinder configured to swing the bucket 11. The bucket cylinder 17 couples between the left portion of the bucket 11 and the boom arranged on the left, and couples between the right portion of the bucket 11 and the boom arranged on the right.

In addition, in place of the bucket 11, an auxiliary attachment such as a hydraulic crusher, a hydraulic breaker, an angle broom, an auger, a pallet fork, a sweeper, a mower, a snow blower or the like can be attached to the tip end (the front portion) of the boom 10.

In the present embodiment, the traveling device 5A and the traveling device 5B employ the Wheel-type traveling devices 5A and 5B each having a front wheel 5F and a rear wheel 5R. Note that crawler-type traveling devices 5A and 5B (including semi-crawler type traveling devices 5A and 5) may be employed as the traveling devices 5A and 5B.

Next, a working hydraulic circuit (a working hydraulic system) provided in the skid steer loader 1 will be described below.

The working hydraulic system is a system configured to operate the boom 10, the bucket 11, the auxiliary attachment, and the like, and as shown in FIG. 1, the working hydraulic system includes a plurality of control valves 20 and a hydraulic pump (a first hydraulic pump) P1 for the working system. In addition, the working hydraulic system includes a second hydraulic pump P2 other than the first hydraulic pump P1.

The first hydraulic pump P1 is a pump configured to be operated by the power of the prime mover 7, and is constituted of a constant displacement type gear pump. The first hydraulic pump P1 is configured to discharge the operation fluid stored in the tank (the operation fluid tank) 15.

The second hydraulic pump P2 is a pump configured to be operated by the power of the prime mover 7, and is constituted of a constant displacement type gear pump. The second hydraulic pump P2 is configured to discharge the operation fluid stored in the tank (the operation fluid tank) 15.

The second hydraulic pump P2 discharges the operation fluid for signals and the operation fluid for control in a hydraulic system. The operation fluid for signal and the operation fluid for control are referred to as pilot fluid.

The plurality of control valves 20 are valves configured to control various types of hydraulic actuators provided in the working machine 1. The hydraulic actuator is a device configured to be operated by the operation fluid, such as a hydraulic cylinder, a hydraulic motor, or the like.

In the embodiment, the plurality of control valves 20 include a boom control valve 20A, a bucket control valve 20B, and an auxiliary control valve 20C.

The boom control valve 20A is a valve configured to control a hydraulic actuator (a boom cylinder) 14 that is configured to operate the boom 10. The boom control valve 20A is a three-position switching valve of a direct-acting spool type. The boom control valve 20A is switched between a neutral position 20*a*3, and a first position 20*a*1 other than the neutral position 20*a*3, and a second position 20*a*2 other than the neutral position 20*a*3 and the first position 20*a*1.

In the boom control valve 20A, the switching between the neutral position 20*a*3, the first position 20*a*1, and the second position 20*a*2 is performed by the spool moved in the operation of the operation member.

The boom control valve 20A is switched by directly moving the spool through the manual operation of the operation member. However, the spool may be moved by the hydraulic operation (the hydraulic operation by a pilot valve, and the hydraulic operation by a proportional valve), and the spool may be moved by the electrical operation (the electrical operation by magnetizing a solenoid) or may be moved by other methods.

The boom control valve 20A is coupled to the first hydraulic pump P1 by a output fluid tube 27. A discharge fluid tube 24*a* connected to the operation fluid tank 15 is connected to the output fluid tube 27 that is a section between the boom control valve 20A and the first hydraulic pump P1.

A relief valve (a main relief valve) 25 is provided in the middle portion of the discharge fluid tube 24*a*. The operation fluid outputted from the first hydraulic pump P1 flows through the output fluid tube 27 and is supplied to the boom control valve 20A.

In addition, the boom control valve 20A and the boom cylinder body 14 are coupled to each other by a fluid tube 21.

In particular, the boom cylinder body 14 includes a cylinder body 14*a*, a rod 14*b* provided movably in the cylinder body 14*a*, and a piston 14*c* provided in the rod 14*b*. A first port 14*d* for supplying and discharging the operation fluid is provided at the base end portion (a side opposite to the rod 14*b* side) of the cylinder body 14*a*. A second port 14*e* for supplying and discharging the operation fluid is provided at the tip end (a side on the rod 14*b* side) of the cylindrical body 14*a*.

The fluid tube 21 includes a fluid tube 21*a* and a fluid tube 21*b*. The fluid tube 21*a* couples the first port 31 of the boom control valve 20A to the first port 14*d* of the boom cylinder body 14. The fluid tube 21*b* couples the second port 32 of the boom control valve 20A to a second port 14*e* of the boom cylinder body 14.

Thus, when the boom control valve 20A is set to the first position 20*a*1, the operation fluid can be supplied from the fluid tube 21*a* to the first port 14*d* of the boom cylinder body 14, and the operation fluid can be discharged from the second port 14*e* of the boom cylinder body 14 to the fluid tube 21*b*.

In this manner, the boom cylinder body 14 is stretched, and the boom 10 is moved upward. When the boom control valve 20A is set to the second position 20*a*2, the operation fluid can be supplied from the fluid tube 21*b* to the second port 14*e* of the boom cylinder body 14, and the operation fluid can be discharged from the first port 14*d* of the boom cylinder body 14 to the fluid tube 21*a*. In this manner, the boom cylinder 14 is shortened, and the boom 10 is moved downward.

The bucket control valve 20B is a valve configured to control a hydraulic cylinder (a bucket cylinder) 17 that is configured to control the bucket 11. The bucket control valve 20B is a pilot-type three-position switching valve of a direct-acting spool type. The bucket control valve 20B is switched between a neutral position 20*b*3, a first position 20*b*1 other than the neutral position 20*b*3, and a second position 20*b*2 other than the neutral position 20*b*3 and the first position 20*b*1.

In the bucket control valve 20B, the switching between the neutral position 20*b*3, the first position 20*b*1, and the second position 20*b*2 is performed by the spool moved in the operation of the operation member.

Although the switching of the bucket control valve 20B is performed by moving the spool directly in the manual operation of the operation member, the spool may be moved by the hydraulic operation (the hydraulic operation by a pilot valve, and the hydraulic operation by a proportional valve), and the spool may be moved by the electrical operation (the electrical operation by magnetizing a solenoid) or may be moved by other methods.

The bucket control valve 20B and the bucket cylinder 17 are coupled to each other by a fluid tube 22. In particular, the bucket cylinder 17 includes a cylinder body 17*a*, a rod 17*b* provided movably in the cylinder 17*a*, and a piston 17*c* provided in the rod 17*b*.

A first port 17*d* for supplying and discharging the operation fluid is provided at the base end portion of the cylinder 17*a* (a side opposite to the rod 17*b* side). A second port 17*e* for supplying and discharging the operation fluid is provided at the tip end of the cylindrical body 17*a* (the rod 17*b* side).

The fluid tube 22 includes a first connecting fluid tube 22*a* and a second supply passage 22*b*. The first connecting fluid tube 22*a* couples the first port 35 of the bucket control valve 20B to the second port 17*e* of the bucket cylinder 17, and the second supply passage 22*h* couples a second port 36 of the bucket control valve 20B to a first port 17*d* of the bucket cylinder 17.

Thus, when the bucket control valve 20B is set to the first position 20*b*1, the operation fluid can be supplied from the first connecting fluid tube 22*a* to the second port 17*e* of the bucket cylinder 17, and can be discharged from the first port 17*d* of the bucket cylinder 17 the second supply passage 22*b*.

In this manner, the bucket cylinder 17 is shortened, and the bucket 11 performs the shoveling operation.

When the bucket control valve 20B is set to the second position 20*a*2, the operation fluid can be supplied from the second supply passage 22*b* to the first port 17*d* of the bucket cylinder 17, and can be discharged from the second port 17*e* of the bucket cylinder 17 to the first connecting fluid tube 22*a*.

In this manner, the bucket cylinder 17 is shortened, and the bucket performs the dumping operation.

The auxiliary control valve 20C is a valve configured to control an auxiliary actuator (the hydraulic cylinder, the hydraulic motor, or the like) 16 attached to the auxiliary attachment. The auxiliary control valve 20C is a direct-acting spool type three-position switching valve of a pilot type. The auxiliary control valve 20C is configured to be switched between a neutral position 20*c*3, a first position 20*c*1 other than the neutral position 20*c*3, and a second position 20*c*2 other than the neutral position 20*c*3 and the first position 20*c*1.

In the auxiliary control valve 20C, the switching between the neutral position 20*c*3, the first position 20*c*1, and the second position 20*c*2 is performed by the spool moved by the pressure of the pilot fluid. The connection member 18 is connected to the auxiliary control valve 20C through the supplying-discharging fluid tubes 83*a* and 83*b*. A fluid tube connected to the hydraulic actuator 16 of the auxiliary attachment is connected to the connection member 18.

According to the configuration described above, when the auxiliary control valve 20C is set to the first position 20*c*1, the operation fluid can be supplied from the supplying-discharging fluid tube 83*a* to the hydraulic actuator 16 of the auxiliary attachment. When the auxiliary control valve 20C is set to the second position 20*c*2, the operation fluid can be supplied from the supplying-discharging fluid tube 83*b* to the hydraulic actuator 16 of the auxiliary attachment.

As described above, the hydraulic actuator 16 (the auxiliary attachment) can be operated by supplying the operation fluid to the hydraulic actuator 16 from the supplying-discharging fluid tube 83*a* or the supplying-discharging fluid tube 83*b*.

Meanwhile, a series circuit (a series fluid tube) is adopted to the hydraulic system. In the series circuit, the operation fluid returned from the hydraulic actuator to the control valve arranged upstream can be supplied to the control valve arranged downstream.

For example, focusing on the bucket control valve 20B and the auxiliary control valve 20C, the bucket control valve 20B is a control valve arranged on the upstream side, and the auxiliary control valve 20C is a control valve arranged on the downstream side.

Hereinafter, the control valve arranged on the upstream side is referred to as a "first control valve", and the control valve arranged on the downstream side is referred to as a "second control valve". Other than the first control valve and the second control valve, a control valve arranged on the upstream side of the second control valve is referred to as a "third control valve".

Also, a hydraulic actuator corresponding to the first control valve is referred to as a "first hydraulic actuator", a hydraulic actuator corresponding to the second control valve is referred to as a "second hydraulic actuator", and a hydraulic actuator corresponding to the third control valve is referred to as a "the third hydraulic actuator".

The fluid tube for supplying a return fluid to the second control valve is referred to as a "first fluid tube", the return fluid being the operation fluid returning from the first hydraulic actuator to the first control valve.

In the embodiment, the bucket control valve 20B is a "first control valve", the auxiliary control valve 20C is a "second control valve", and the boom control valve 20A is a "third control valve".

In addition, the bucket cylinder 17 is the "first hydraulic actuator", the hydraulic actuator 16 serving as the auxiliary attachment is the "second hydraulic actuator", and the boom cylinder body 14 is the "third hydraulic actuator".

The first control valve, the second control valve, and the third control valve will be described in detail below.

The third control valve 20A is coupled to the output portion of the first hydraulic pump P1 by an output fluid tube 27. The output fluid tube 27 is branched from a middle portion 47*a*. The branched fluid tube of the output fluid tube 27 is connected to the first input port 46*a* and the second input port 46*b* of the third control valve 20A.

In addition, the output fluid tube 27 is connected to the third input port 46*c* of the third control valve 20A. Thus, the operation fluid outputted from the first hydraulic pump P1 can be supplied into the third control valve 20A through the output fluid tube 27, the first input port 46*a* the second input port 46*b*, and the third input port 46*c*.

The third control valve 20A is coupled to the first control valve 20B by a center fluid tube 51. The center fluid tube 51 couples the third output port 41*c* of the third control valve 20A to the third input port 42*c* of the first control valve 20B.

Now, when the third control valve 20A is set to the neutral position 20*a*3, the supply fluid, which is the operation fluid supplied from the output fluid tube 27 to the third control valve 20A, is supplied to the center fluid tube 51 through the third control valve 20A due to the communication of the center fluid tube 53*c* coupling the third input port 46*c* to the third output port 41*c*.

The third control valve 20A and the first control valve 20B are coupled each other by a return fluid tube 61 separately from the center fluid tube 51. The return fluid tube 61 is a fluid tube for supplying the return fluid to the first control valve 20B through the third control valve 20A, the return fluid returning from the third hydraulic actuator 14 back to the third control valve 20A.

The return fluid tube 61 includes an internal fluid tube 61*a* and an external fluid tube 61*b*. The internal fluid tube 61*a* is a fluid tube provided in the third control valve 20A and communicated with the fluid tube 21*b*.

In particular, the internal fluid tube 61*a* is a fluid tube configured to couples the first port 31 of the third control valve 20A to the first output port 41*a* of the third control valve 20A when the third control valve 20A is set to the second position 20*a*2.

The external fluid tube 61*b* is a fluid tube that is communicated with the internal fluid tube 61*a* and is connected to the first control valve 20B. The external fluid tube 61*b* couples the first output port 41*a* of the third control valve 20A to the first input port 42*a* of the first control valve 20B, and couples the second output port 41*b* of the third control valve 20A to the second input port 42*b* of the first control valve 20B. The middle portion of the external fluid tube 61*b* is connected to the center fluid tube 51.

In other words, the external fluid tube 61*b* is confluent with the center fluid tube 51 at the middle portion. In the external fluid tube 61*b*, a check valve 29*a* is provided between the first control valve 20B and a confluent portion 63 where the external fluid tube 61*b* is confluent with the center fluid tube 51. The check valve 29*a* allows the operation fluid to flow from the confluent portion 63 to the first control valve 20B, and prevents the operation fluid from flowing from the first control valve 20B to the confluent portion 63.

Further, in the external fluid tube 61*b*, a check valve 64 is provided between the confluent portion 63 and the third control valve 20A. The check valve 64 allows the operation fluid to flow from the third control valve 20A to the confluent portion 63, and prevents the operation fluid from flowing from the confluent portion 63 to the third control valve 20A.

The fluid tube 21*b* is connected to the discharge fluid tube 24*b*. The discharge fluid tube 24*b* includes a fluid tube 24*b*1 connected to the fluid tube 21*b*, a fluid tube 24*b*2 connected to the first discharge port 33*a* of the third control valve 20A and to the second discharge port 33*b* of the third control valve 20A, and a fluid tube 24*b*3 coupling the operation fluid tank 15 to the confluent portion between the fluid tube 24*b*1 and the fluid tube 24*b*2.

A relief valve 37 is provided in the middle portion of the fluid tube 24*b*1. The set pressure of the relief valve 37 is set to be higher than the set pressure of the main relief valve 25, for example.

The first control valve 20 B and the second control valve 20C are coupled each other by a center fluid tube (a second fluid tube) 72. The center fluid tube 72 couples the third output port 43*c* of the first control valve 20B to the third input port 44*c* of the second control valve 20C.

In this manner, when the first control valve 20B is in the neutral position 20*b*3, the supply fluid, which is the operation fluid supplied to the first control valve 20B, is supplied to the center fluid tube 72 connected to the third output port 43*c* through a center fluid tube 73*c* coupling between the third input port 42*c* and the third output port 43*c*.

The first control valve 20 B and the second control valve 20 C are coupled each other by the first fluid tube 81 separately from the center fluid tube 72. The first fluid tube 81 is a fluid tube that supplies the return fluid, which is returned from the first hydraulic actuator 17 to the first control valve 20B, to the second control valve 20C through the first control valve 20B.

That is, the first fluid tube 81 is a fluid tube that supplies, to the second control valve 20*c*, the return fluid which is the operation fluid that returns from either one of the first connecting fluid tube 22*a* and the second connecting fluid tube 22*b* to the first control valve 20B.

The first fluid tube 81 includes an internal fluid tube 81*a*, an external fluid tube 81*b*, and an internal fluid tube 81*c*.

The internal fluid tube 81*a* is a fluid tube provided in the first control valve 20B and communicated with the first connecting fluid tube 22*a*. In particular, the internal fluid tube 81*a* is a fluid tube that couples the first port 35 of the first control valve 20B to the first output port 43*a* of the first control valve 20B when the first control valve 20B is set to the second position 20*b*2.

The internal fluid tube 81*c* is a fluid tube provided in the first control valve 20B and communicated with the second connecting fluid tube 22*b*. In particular, the internal fluid tube 81*c* is a fluid tube that couples the second port 36 of the first control valve 20B to the second output port 43*b* of the first control valve 20B when the first control valve 20B is set to the first position 20*b*1.

The external fluid tube 81*b* is a fluid tube that is communicated with the internal fluid tube 81*a* and the internal fluid tube 81*c* and is connected to the second control valve 20C. The external fluid tube 81*b* couples the first output port 43*a* of the first control valve 20B to the first input port 44*a* of the second control valve 20C, and couples the second output port 43*b* of the first control valve 20B to the second input port 44*b* of the second control valve 20C.

The middle portion of the external fluid tube 81*b* is connected to the center fluid tube 73*c*. In other words, the external fluid tube 81*b* is confluent with the center fluid tube 73*c* at the middle portion. In the external fluid tube 81*b*, a check valve 29*b* is provided between the second control valve 20C and a confluent portion 93 where the external fluid tube 81*b* is confluent with the center fluid tube 73*c*.

The check valve 29*b* allows the operation fluid to flow from the confluent portion 93 to the second control valve 20C, and prevents the operation fluid from flowing from the second control valve 20C to the confluent portion 93.

In addition, in the external fluid tube 81*b*, a check valve 94 is provided between the confluent portion 93 and the first control valve 20B. The check valve 94 allows the operation fluid to flow from the first control valve 20B to the confluent portion 93, and prevents the operation fluid from flowing from the confluent portion 93 to the first control valve 20B.

In addition, the fluid tube (the second connecting fluid tube) 22*b* is connected to the discharge fluid tube 24*b*. The discharge fluid tube 24*b* includes a fluid tube 24*b*4 connected to the first connecting fluid tube 22*a* and to the second connecting fluid tube 22*b*. The fluid tube 24*b*4 is connected to a fluid tube 24*b*3 that is communicated with the operation fluid tank 15, and a relief valve 38 is provided in the fluid tube 24*b*4.

According to the configuration described above, when the first control valve 20B is set to the second position 20*b*2, the supply fluid is supplied to the second input port 42*b*, and the supply fluid passes through the second connecting fluid tube 22*b* and then is supplied to the first hydraulic actuator 17.

In addition, when the first control valve 20B is set to the second position 20*b*2, the return fluid discharged from the second port 17*e* of the first hydraulic actuator 17 is flow toward the second control valve 20C through the first connecting fluid tube 22*a*, the internal fluid tube 81*a*, and the external fluid tube 81*b*.

Further, when the first control valve 20B is set to the first position 20*b*1, the supply fluid is supplied to the first input port 42*a*, and the supply fluid is supplied to the first hydraulic actuator 17 through the first connecting fluid tube 22*a*.

When the first control valve 20B is set to the first position 20*b*1, the return fluid discharged from the first port 17*d* of the first hydraulic actuator 17 flows toward the second control valve 20C through the second connecting fluid tube 22*b*, the internal fluid tube 81*c*, and the external fluid tube 81*b*.

Meanwhile, the hydraulic system for the working machine has a first communication passage 110 and a second communication passage 120. The first communication passage 110 and the second communication passage 120 are passages formed in the inside of the first control valve 20B, that is, in the spool, for example.

The first communication passage 110 is communicated with the second fluid tube 72 when the first control valve 20B is set to the first position 20*b*1. The second communication passage 120 is communicated with the second fluid tube 72 when the first control valve 20B is set to the second position 20*b*2.

In particular, when the first control valve 20B is set to the first position 20*b*1, the first communication passage 110 establishes communication between the third input port 42*c* of the first control valve 20B and the third output port 43*c* of the first control valve 20B.

When the first control valve 20B is set to the second position 20*b*2, the second communication passage 120 establishes communication between the third input port 42*c* of the first control valve 20B and the third output port 43*c* of the first control valve 20B.

According to the configuration described above, when the first control valve 20B is, for example, a bucket control valve, the bucket 11 can perform the shoveling operation (the scraping operation) when the bucket control valve is set to the first position 20*b*1.

When the scraping operation is performed as described above, the first communication passage 110 communicates the third input port 42*c* with the third output port 43*c* of the first control valve 20B.

Here, even when a large load is applied to the bucket 11 in the scraping operation, a part of the operation fluid outputted from the first hydraulic pump P1 is released to the second fluid tube 72 through the first communication passage 110. In this manner, the load applied to the prime mover 7 can be reduced to prevent the engine stalls and the like.

In addition, also when the bucket control valve is set to the second position 20*b*2 and thereby the bucket 11 performs the dumping operation, the second communication port 120 communicates the third input port 42*c* with the third output port 43*c* of the first control valve 20B.

As described above, although the first control valve 20B is provided with both the first communication passage 110 and the second communication passage 120, the first opening area (a cross-sectional opening area) through which the operation fluid passes in the first communication passage 110 is set to be smaller than the second opening area (a cross-sectional opening area) through which the operation fluid passes in the second communication passage 120.

In particular, the first communication passage 110 has a throttle portion 111 for reducing the flow rate of the operation fluid, and the second communication passage 120 has a throttle portion 121 for reducing the flow rate of the operation fluid. The opening area (the first opening area) of the portion 111 is set to be smaller than the opening area (the second opening area) of the through portion 121.

As described above, the bucket cylinder 17 is a hydraulic cylinder configured to be stretched and shortened. In the bucket cylinder 17, the cross-sectional area on the bottom side is the cross-sectional area of the cylinder tube, and the cross-sectional area on the rod side is the cross-sectional area substantially equal to a difference between the cross-sectional area of the cylinder tube and the cross-sectional area of the cylinder rod (a cross-sectional area obtained by subtracting the cross-sectional area of the cylinder rod from the cross-sectional area of the cylinder tube). That is, the cross-sectional area on the bottom side is larger than the cross-sectional area on the rod side.

As described above, since the cross-sectional area on the bottom side and the cross-sectional area on the rod side are different from each other, the pressure of the operation fluid varies when the bucket cylinder 17 is stretched and shortened. For example, when the bucket cylinder 17 is shortened (the first control valve 20B is set to the first position 20*b*1)

and the bucket 10 performs the scraping operation, the pressure of the operation fluid (the supply fluid) is high.

On the other hand, when the bucket cylinder 17 is stretched (the first control valve 20B is set to the second position 20*b*2) and the bucket 10 performs the dumping operation, the pressure of the operation fluid (the supply fluid) is low.

As described above, considering that the pressure in the bucket cylinder 17 is different in stretching the bucket cylinder 17 from in shortening the bucket cylinder 17, as smaller the first opening area of the throttle portion 11 is, as more the supply of the operation fluid to the bucket cylinder 17 and the like can be increased when the first control valve 20B is in the first position 20*b*1, and thereby the moving speed of the bucket cylinder 17 can be increased.

In addition, when the second opening area of the throttle portion 121 is increased, the return fluid passing through the first fluid tube 81 can be returned to the input port of the first control valve 20B through the second fluid tube 72 and the second communication passage 120 when the first control valve 20B is set to the second position 20*b*2. In this manner, the moving speed of the bucket cylinder 17 can be increased.

In addition, in the situation where an external force is applied to the bucket cylinder 17 or the cylinder does not move due to the cylinder end at each of the stretching and shortening of the bucket cylinder 17, the communicating-connection tube (the first communication passage 110, the second communication passage 120) reduces the flow rate of the operation fluid passing through the relief valve 25 is decreased (a relief pressure of the relief valve 25 is decreased) When the opening area of the communicating-connection tube (the first communication passage 110, the second communication passage 120) is large.

As described above, since the bucket cylinder 17 has the cross-sectional areas different from each other, the thrust power for the stretching is large (the dumping operation), and the thrust power for the shortening (the scraping operation) is small. In the case of the stretching (the dumping operation), a sufficient force is requested provided even when the relief pressure of the relief valve 25 is low; and in the case of the shortening (the scraping operation), the relief pressure is requested to be high to provide the force.

Meanwhile, the thrust power (the cylinder thrust power) is obtained in the following formula.

$$\text{Cylinder thrust power} = \text{Cylinder cross-sectional area} \times \text{Pressure} \times \text{Cylinder efficiency}$$

That is, as described above, by making the first opening area smaller than the second opening area, the dumping operation can be smoothly performed while suppressing the consumption horsepower in the scraping operation.

In other words, by making the first opening area of the first communication passage 110 smaller than the second opening area of the second communication passage 120, the operating speed of the scraping operation can be secured while suppressing the engine stall under the high load of the scratching operation. In addition, the operating speed of the dumping operation also can be secured.

In the embodiment described above, the bucket cylinder 17 has been described as an example. However, the same effect can be obtained in other hydraulic cylinders.

In the embodiment described above, the first hydraulic actuator is the bucket cylinder 17, the second hydraulic actuator is the auxiliary actuator 16, the first control valve is the bucket control valve 20B, and the second control valve is the spare control valve 20C. However, the configurations are not limited to those mentioned above.

The hydraulic system for the working machine is provided with a first communication passage 110 and a second fluid communication 120. The first communication passage 110 is configured to be communicated with the second fluid tube when the first control valve is set to the first position. The second communication passage 120 is configured to be communicated with the second fluid tube when the first control valve is set to the second position.

In this manner, by switching the first control valve to the first position or to the second position, the first hydraulic actuator can perform at least two operations, that is, an operation corresponding to the first position and an operation corresponding to the second position.

In the case where the first hydraulic actuator performs the operation corresponding to the first position, the first hydraulic actuator can be communicated with the second fluid tube by the first communication passage 110. And, in the case where the first hydraulic actuator performs the operation corresponding to the second position, the first hydraulic actuator can be communicated with the second fluid tube by the second communication passage 110.

Thus, also in the case where the first control valve is applied to a valve other than the bucket control valve, the two operations at least can be smoothly performed on the hydraulic actuator, as in the case of the bucket control valve.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to those of the above-described embodiment, and any control valve provided in the working machine may be adopted.

In the embodiment described above, the operation fluid is discharged to the operation fluid tank. However, the operation fluid may be discharged to other places. That is, the fluid tube for discharging the operation fluid may be connected to the portion other than the operation fluid tank. For example, the fluid tube may be connected to the suction portion (portion from which the operation fluid is sucked) of the hydraulic pump, or may be connected to a portion other than the suction portion.

In the embodiment described above, the control valve is constituted of a three-position switching valve. However, the number of switching positions is not limited to that, and a two-position switching valve, a four-position switching valve, or other switching valve may be employed as the control valve.

In the embodiment described above, the hydraulic pump is constituted of a constant displacement pump. However, the hydraulic pump, for example, may be constituted of a variable displacement pump whose outputting amount is changed by moving the swash plate, or may be constituted of another hydraulic pump.

In addition, the configurations of the first hydraulic actuator, the second hydraulic actuator, the third hydraulic actuator, the first control valve, the second control valve, and the third control valve are not limited to those of the embodiment described above. The configurations provided in the working machine 1 may be adopted to the first hydraulic actuator, the second hydraulic actuator, the third hydraulic actuator, the first control valve, the second control valve, and the third control valve.

What is claimed is:

1. A hydraulic system for a working machine, comprising:
a prime mover;
a hydraulic pump to be driven by the prime mover and to output an operation fluid;
a first hydraulic actuator;
a second hydraulic actuator;
a first connecting fluid tube connected to the first hydraulic actuator;
a second connecting fluid tube connected to the first hydraulic actuator;
a first control valve having a first position allowing the operation fluid to be supplied to the first connecting fluid tube, and a second position allowing the operation fluid to be supplied to the second connecting fluid tube;
a second control valve to control the second hydraulic actuator, the second control valve being arranged on a downstream side of the first control valve;
a first fluid tube to supply a return fluid to the second control valve and to couple the first control valve to the second control valve, the return fluid being the operation fluid returning from any one of the first connecting fluid tube and the second connecting fluid tube to the first control valve;
a second fluid tube coupling the first control valve to the second control valve and being connected to the first fluid tube;
a first communicating-connection tube to be connected to the second fluid tube when the first control valve is in the first position; and
a second communicating-connection tube to be connected to the second fluid tube when the first control valve is in the second position,
wherein a first opening area of the first communicating-connection tube through which the operation fluid flows is smaller than a second opening area of the second communicating-connection tube through which the operation fluid flows.

2. The hydraulic system according to claim 1,
wherein the first control valve includes:
an input port to which the operation fluid outputted from the hydraulic pump is inputted; and
an output port to which the second fluid tube is connected,
wherein the first communicating-connection tube couples the input port to the output port when the first control valve is in the first position,
and wherein the second communicating-connection tube couples the input port to the output port when the first control valve is in the second position.

3. The hydraulic system according to claim 2,
wherein the first communicating-connection tube and the second communicating-connection tube are arranged inside the first control valve.

4. The hydraulic system according to claim 2,
wherein the first hydraulic actuator is a hydraulic cylinder to be stretched and shortened and to output the operation fluid as the return fluid in being stretched and being shortened,
and wherein the first control valve shortens the hydraulic cylinder when the first control valve is in the first position and stretches the hydraulic cylinder when the first control valve is in the second position.

5. The hydraulic system according to claim 2, comprising:
a bucket; and
an auxiliary attachment arranged on the boom,
wherein the first hydraulic actuator is a bucket cylinder to operate the bucket,
wherein the second hydraulic actuator is an auxiliary actuator to operate the auxiliary attachment,
wherein the first control valve is a bucket control valve to control the bucket cylinder,
and wherein the second control valve is an auxiliary control valve to control the auxiliary actuator.

6. The hydraulic system according to claim 1,
wherein the first communicating-connection tube and the second communicating-connection tube are arranged inside the first control valve.

7. The hydraulic system according to claim 6,
wherein the first hydraulic actuator is a hydraulic cylinder to be stretched and shortened and to output the operation fluid as the return fluid in being stretched and being shortened,
and wherein the first control valve shortens the hydraulic cylinder when the first control valve is in the first position and stretches the hydraulic cylinder when the first control valve is in the second position.

8. The hydraulic system according to claim 6, comprising:
a bucket; and
an auxiliary attachment arranged on the boom,
wherein the first hydraulic actuator is a bucket cylinder to operate the bucket,
wherein the second hydraulic actuator is an auxiliary actuator to operate the auxiliary attachment,
wherein the first control valve is a bucket control valve to control the bucket cylinder,
and wherein the second control valve is an auxiliary control valve to control the auxiliary actuator.

9. The hydraulic system according to claim 1,
wherein the first hydraulic actuator is a hydraulic cylinder to be stretched and shortened and to output the operation fluid as the return fluid in being stretched and being shortened,
and wherein the first control valve shortens the hydraulic cylinder when the first control valve is in the first position and stretches the hydraulic cylinder when the first control valve is in the second position.

10. The hydraulic system according to claim 9, comprising:
a bucket; and
an auxiliary attachment arranged on the boom,
wherein the first hydraulic actuator is a bucket cylinder to operate the bucket,
wherein the second hydraulic actuator is an auxiliary actuator to operate the auxiliary attachment,
wherein the first control valve is a bucket control valve to control the bucket cylinder,
and wherein the second control valve is an auxiliary control valve to control the auxiliary actuator.

11. The hydraulic system according to claim 1, comprising:
a bucket; and
an auxiliary attachment arranged on the boom,
wherein the first hydraulic actuator is a bucket cylinder to operate the bucket,
wherein the second hydraulic actuator is an auxiliary actuator to operate the auxiliary attachment,
wherein the first control valve is a bucket control valve to control the bucket cylinder,
and wherein the second control valve is an auxiliary control valve to control the auxiliary actuator.

12. A hydraulic system for a working machine, comprising:

a prime mover;

a hydraulic pump to be driven by the prime mover and to output an operation fluid;

a first hydraulic actuator;

a second hydraulic actuator;

a first connecting fluid tube connected to the first hydraulic actuator;

a second connecting fluid tube connected to the first hydraulic actuator;

a first control valve having a first position allowing the operation fluid to be supplied to the first connecting fluid tube, and a second position allowing the operation fluid to be supplied to the second connecting fluid tube;

a second control valve to control the second hydraulic actuator, the second control valve being arranged on a downstream side of the first control valve;

a first fluid tube to supply a return fluid to the second control valve and to couple the first control valve to the second control valve, the return fluid being the operation fluid returning from any one of the first connecting fluid tube and the second connecting fluid tube to the first control valve;

a second fluid tube coupling the first control valve to the second control valve and being connected to the first fluid tube;

a first communicating-connection tube to be connected to the second fluid tube when the first control valve is in the first position; and a second communicating-connection tube to be connected to the second fluid tube when the first control valve is in the second position, wherein the first control valve includes:

an input port to which the operation fluid outputted from the hydraulic pump is inputted; and an output port to which the second fluid tube is connected, wherein the first communicating-connection tube couples the input port to the output port when the first control valve is in the first position, and wherein the second communicating-connection tube couples the input port to the output port when the first control valve is in the second position.

13. The hydraulic system according to claim 12, wherein the first communicating-connection tube and the second communicating-connection tube are arranged inside the first control valve.

14. The hydraulic system according to claim 12, wherein the first hydraulic actuator is a hydraulic cylinder to be stretched and shortened and to output the operation fluid as the return fluid in being stretched and being shortened, and wherein the first control valve shortens the hydraulic cylinder when the first control valve is in the first position and stretches the hydraulic cylinder when the first control valve is in the second position.

15. The hydraulic system according to claim 12, comprising:

a bucket; and an auxiliary attachment arranged on the boom, wherein the first hydraulic actuator is a bucket cylinder to operate the bucket, wherein the second hydraulic actuator is an auxiliary actuator to operate the auxiliary attachment, wherein the first control valve is a bucket control valve to control the bucket cylinder, and wherein the second control valve is an auxiliary control valve to control the auxiliary actuator.

* * * * *